United States Patent [19]

Anderson

[11] Patent Number: 4,942,941

[45] Date of Patent: Jul. 24, 1990

[54] ANTI-SPIN HANDLE FOR PUMP JACK

[76] Inventor: Carl Anderson, c/o Alum-A-Pole Corporation, P. O. Box 030066, Staten Island, N.Y. 10303-002

[21] Appl. No.: 262,465

[22] Filed: Oct. 25, 1988

[51] Int. Cl.[5] ..... A63B 27/00

[52] U.S. Cl. ..... 182/136; 248/243; 254/106

[58] Field of Search ..... 182/136, 133, 135, 82, 182/5, 240, 236; 248/243, 244, 245; 254/106

[56] References Cited

U.S. PATENT DOCUMENTS

| | | | |
|---|---|---|---|
| 297,126 | 4/1884 | Freeman | 182/235 |
| 612,673 | 10/1898 | Reidy et al. | 182/235 |
| 728,208 | 5/1903 | Dampfr | 182/235 |
| 876,004 | 1/1908 | Liberty | 182/75 |
| 4,463,828 | 8/1984 | Anderson | 182/136 |

*Primary Examiner*—Alvin C. Chin-Shue
*Attorney, Agent, or Firm*—Helfgott & Karas

[57] ABSTRACT

A pump jack for traveling up and down a pole includes a frame member and upper and lower shackles supported on the frame member. A pump arm is coupled to the pump jack and is operated for alternatively gripping the pole by the upper and lower shackles. The upper shackle has a helical rod which is cranked by a handle to roll along the surface of the pole. To prevent an accidental rolling of the helical rod and thus slipping of the pump jack down the pole, and anti-spin friction device including a rubber disc and a bolt acting thereon, is provided on the end of the helical rod opposite to that which carries the handle.

24 Claims, 3 Drawing Sheets

ANTI-SPIN HANDLE FOR PUMP JACK

BACKGROUND OF THE INVENTION

The present invention relates to pump jacks for traveling up and down a pole in general, and more particularly to safety means preventing accidental sliding of the pump jack down the pole even when lubricity is being applied.

As has been known, pump jacks of the type under consideration have been employed in scaffolding systems for raising and lowering scaffolding platforms. Typically, a number of pump jack poles are secured in spaced relationship to a house or building to be worked on, and pump jacks are utilized to ride up and down the poles. Scaffolding staging or platforms are extended across the support arms provided on the pump jacks. The workers can stand on the scaffolding staging and operate the pump jacks to move the staging up and down along the pump jack poles.

Each pump jack in such constructions includes a frame with an upper and a lower shackle. A pump arm is pivotally connected to the frame to operate two shackles alternatively. The operation causes the upper shackle to grip the pole permitting the frame to step upward along the pole. The weight thereafter shifts so that the lower shackle grips the pole and the upper shackle steps up to a next position on the pole. In this manner, one of the shackles steps up the pole while the other shackle grips the pole.

The upper shackle can include a forward helical rod which applies a coupling force to the pole to grip the pole. A crank handle coupled to the helical rod permits winding and unwinding of the rod. To lower the pump jack, a release lever releases the lower shackle from engagement with the pole. The crank handle is then operated to unwind the helical rod thereby rolling the pump jack down the pole. In order to prevent accidental unwinding of the crank handle, the handle has a safety locking position in which it is bent inwardly so that it is retained in place by the pump jack frame which blocks the handle to prevent accidental unwinding of the helical rod. A pump jack of the aforedescribed construction has been disclosed, for example, in applicant's Patent No. 4,463,828. A further improvement on such helical rod includes the presence of a safety cover over the helical rod. Such is described in applicant's Patent No. 4,597,471.

One of the most critical concerns when using pump jacks is the safety of the workers standing on the staging supported by the pump jacks. Despite the presence of the handles which should be bent inwardly to prevent accidental unwinding, sometimes workers forget to fold the handle into the safety position. This might cause an accidental slipping of the pump jack down once the weight is placed on the staging.

Pump-jack failures, and subsequent physical harm or even fatal accidents have been also experienced because oil could not be used on handle crank shafts. Without lubricity, however, the handle crank shaft or arm, due to abrasion, grinds down to the point where it can break out from the holder. Non-lubricated shoulder bushings have been used in connections between the crank arm or shaft and the coupling arm of the handle, to minimize wear on the crank shaft. However, lubricity of the crank shaft is still not possible since this would cause unwinding of the crank shaft and spin-out of the roller whereby the pump jack would slide down the pole.

Therefore without the lubricity, the possibility of breakage of the crank shaft is still a potential problem.

It has also been found that as the upper shackle is stepping up the pole, there is a tendency for the crank spiral to turn up to about 170° with each upward pumping stroke. This substantially reduces the amount of vertical distance stepped upwardly with each pumping stroke.

Accordingly, there has been need to provide a helical rod of the upper shackle of the pump jack with reliable safety means which would prevent accidental unwinding of the rod and spin-out of the handle even if the worker forgets to place it to the locking position of engagement with the pole, and at the same time permit lubricity of the helical rod crank shaft while at the same time increasing the step-up efficiency.

SUMMARY OF THE INVENTION

It is therefore an object of the present invention to provide an improved safety means for the pump jack to prevent its accidental slipping along the pole.

It is another object of the present invention to provide the pump jack with an anti-spin handle.

Yet another object of the present invention is to provide a handle and helical rod assembly of the pump jack with means permitting the use of ball bearings, permanent lubrication, etc.

Yet a further object is to increase the efficiency of pump jack operation by increasing the upward distances of climb per each upward pumping stroke.

Briefly, in accordance with the present invention, there is provided a pump jack which travels up and down a pump jack pole by means of two shackles alternatively gripping the pole upon the actuation of a pump arm. An upper shackle includes a helical rod which can be wound and unwound by means of a cranking handle connected to one end of the helical rod to roll the helical rod along the surface of the pole. The helical rod is provided, on its other hand, with an anti-spin clutch device which applies a friction force to the helical rod so as to brake its cranking motion and thereby prevent accidental slipping of the pump jack down the pole.

Although the handle provided on the helical rod is arranged so that it can be placed into a locking position to engage with the frame of the pump jack and thereby secure the position of the upper shackle and thus the pump jack on the pole, the anti-spin clutch according to the present invention applies a friction force to the helical rod to prevent its unwinding even if the handle is not turned to its safety position.

In an embodiment, an anti-spin clutch device which operates as a friction applying mechanism includes a resilient member, preferably of rubber, engaging an axial shaft portion of the helical rod, and an externally operated bolt which positions the resilient member to control the extent of the frictional force generated on the end of the helical rod.

In an embodiment, a washer and a bolthead are provided on the end of the axial shaft portion of the helical rod. In operation, the resilient element presses against the bolthead which results in the frictional clutch on the end of the helical rod.

In order to facilitate the normal winding of the helical rod by means of the handle to lower the pump jack down the pole, the handle itself is made longer, for example, by one inch, as compared with conventional handles, whereby the mechanical advantage is increased to overcome the frictional force provided the the axial clutch.

Because of the frictional clutch retarding the unwinding, it has now been found that lubricity can be applied to the crank shaft of the helical rod without fear of accidental spin-out. Such lubricity can also include the use of permanent lubrication, as for example, on shoulder bushings or could even include the use of ball bearings.

An unexpected benefit of the present invention was in the increased efficiency in the upward movement of the pump jack along the pole. Normally there is a tendency for the crank spiral of the helical rod to turn up to 170° with each upward pumping stroke. The anti-spin clutch restricts this motion. As a result, there is increased distance of vertical upward movement with each pumping stroke. This permits the workers to move upward faster.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

Figure 1:
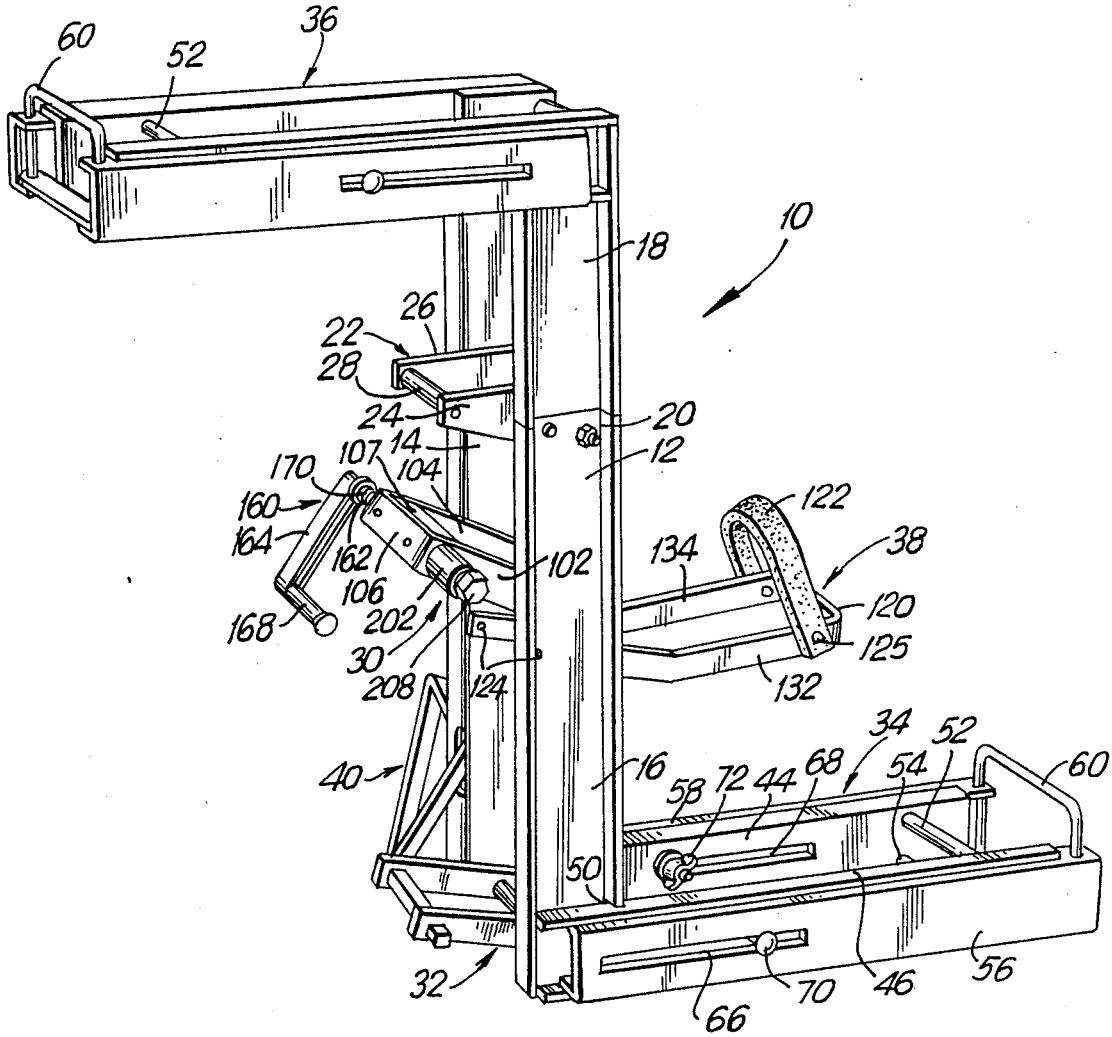
FIG. 1 is a perspective view of a pump jack with an axial-perma-clutch according to the invention.

Referring now to the drawings in detail, FIG. 1 illustrates a pump jack for traveling up and down a pole, which pump jack is generally designated at 10 and comprises a frame which straddles a pole and has two opposing vertical frame members 12 and 14. These frame members 12, 14, are formed of substantially U-shaped channeled posts each including a lower section 16 and an upper section 18 which are connected to each other by bolts 20. A spacing member 22 to space apart the opposing side walls of frame members 12 and 14 is inserted between the inner walls of the frame members 12, 14. Spacing member 22 includes side plates 24, 26 spaced from each other by a roller 28. A similar roller (not shown) may be provided at the rear ends of the side plates 24, 26. Spacing member 22, as known, straddles around the pole to maintain the pump jack 10 vertical along the pole.

As is also known, the pump jack 10 further includes an upper shackle member 30 and a lower shackle member 32. There is also arranged at the lower ends of the frame members 12, 14, a lower support arm 34 extending in one direction normally to the frame members. A second or upper support arm 36 projects from the upper end of frame members 12, 14 in the direction opposite to that of support arm 34 and also normally to the vertical frame members. A pump arm 38 is provided intermediate support arms 34 and 36 to operate the upper and lower shackles 30, 32 to alternately grip onto the pole in a conventional fashion thereby permitting upward stepping of the pump jack along the pole.

A release lever 40 pushes the lower shackle 32 forward to release it from the pole thereby permitting rolling down of the pump jack to lower the pump jack 10 down the pole, as will hereinafter be described.

Support arms 34 and 36 are also of conventional type and are formed substantially identically. The support arms 34, 36 each includes a pair of opposing U-shaped channeled members 44, 46 which are secured directly to the opposing channel faces of the frame members 12, 14. Lower portions 16 of the vertical frame members 12, 14 can be notched at 50 so as to accommodate horizontal channeled members 44, 46. Transverse rods 52, 54 vertically spaced from each other can be placed between the internal surfaces of the channeled members 44, 46 to maintain the ends of these members in spaced relationship and to securely hold the same.

A further pair of U-shaped channeled inverted members 56, 58, which are slightly narrower than and respectively cooperating with channeled members 46, 44 are provided. They are positioned to slidably fit within the channels of the first pair of the channeled members 46, 44. U-shaped brackets or handles 60 interconnect the distal ends of the outer channeled members 56, 58 of each support arm to facilitate sliding of the outer channeled members inward and outward relative to the inner channeled members 44, 46. Two elongated slots 66 are formed in the outer channeled members 56, 58. A corresponding pair of elongated slots 68 are formed in the inner channeled members 44, 46. Screws 70 having wing nuts denoted at 72 pass through the aligned pairs of slots so as to lock the outer channeled members 56, 58 to the inner channeled members 44, 46 at the desired position along the axis of elongation of each support arm 34, 36. Thereby, support arms 34, 36 can be extended outwardly, or moved inwardly to the position shown in FIG. 1. Varying of the length of the support arms 34, 36 permits accommodation of different widths of scaffolding platforms which are normally placed on the support arms. The support arms, as is also known in the prior art pump jacks, may be additionally provided with pivotal folding sections which can be folded inwardly to abut against the support arm or pivoted outwardly to extend the length of the respective support arm. Further details of the operation of the pump jacks can be found in U.S. Pat. Nos. 4,463,828 and 4,597,471, both of which are incorporated herein by reference.

Figure 2:
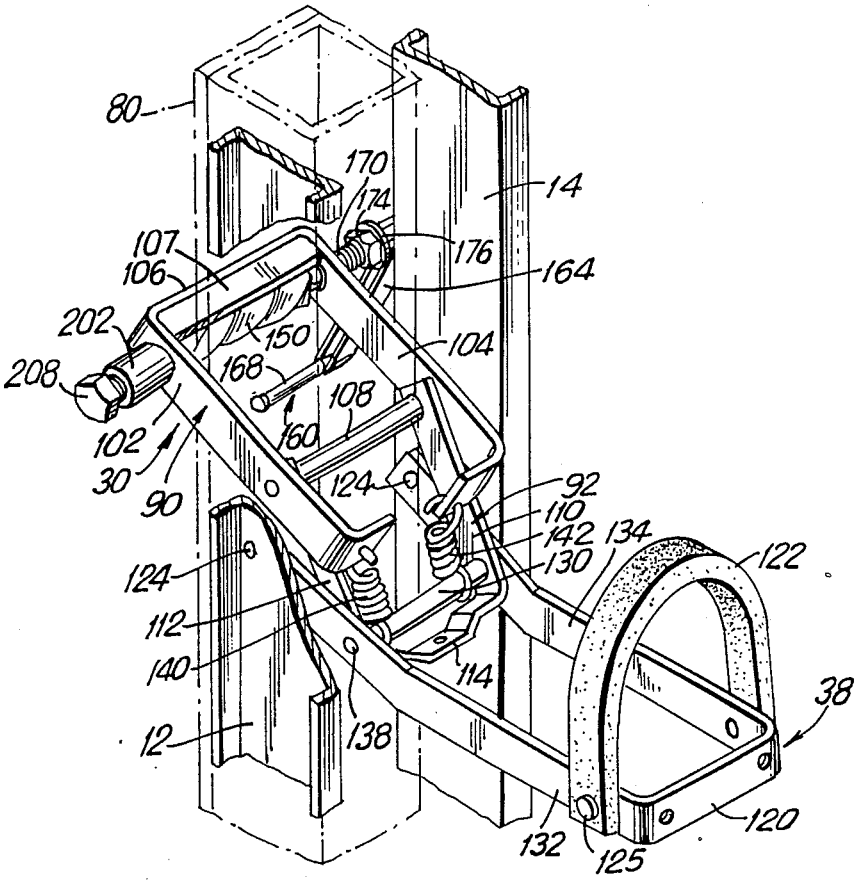
FIG. 2 is an exploded, partially cutaway, perspective view illustrating an upper shackle member with the axial-perma-clutch according to the invention.

Referring now to FIG. 2, there are shown the upper shackle 30 and the pump arm 38 in greater detail. The upper shackle shown is, with the exception of the present invention, of a substantially known construction. The upper shackle 30 is formed as a substantially four sided yoke member in which pole 80 shown in dotted lines would be inserted. The upper shackle 30 fits between two opposing inner faces of the frame members 12, 14 of the pump jack. The pump arm 38 is utilized to control the action of the upper shackle 30.

The upper shackle 30, is comprised of two parts, a yoke member 90 and a linkage member 92. The yoke member is of a substantially U-shaped formation and comprises side plates 102, 104 which in operation straddle on either side of pole 80, a front portion 106 and a rear gripping rod 108. The front portion 106 includes a protective cover plate 107 to prevent the rod from causing damage should it snap, as was described in the aforementioned patent.

The linkage member 92, is also of a substantially U-shaped configuration and includes two opposing legs 110, 112 and an interconnecting bar 114. Legs 110, 112 are pivotally connected at their upper ends to the gripping rod 108 whereby member 90 is pivotally connected to the linkage member 92.

The pump arm 38 includes a substantially U-shaped member 120 having a stirrup 122 typically made of rubberized or leather material at its rearward end. The operator's foot is normally placed through stirrup 122. The stirrup 122 is normally connected to the U-shaped member 120 by pivots or pins 125. The forward distal ends of the U-shaped member 120 are pivotally connected at pivot pins 124 to the walls of the vertical frame members 12, 14 of the pump jack. An interconnecting rod 130 connects the opposing legs 110, 112 of the linkage member 92 to two opposing bars 132, 134 of the U-shaped member 120 of the pump arm. Interconnecting rod 130 permits pivoting of the linkage member 92 relative to the pump arm 38 at pivots or pins 138. Two helical springs 140, 142 connect the rear ends of the yoke member 90 to the interconnecting rod 130. These springs bias the yoke member 90 relative to the linkage member 92.

The upper shackle 30 further includes a helical rod 150 which grips pole 80 oppositely the rear rod 108. A handle 160 is coupled to the helical rod 150 to permit winding and unwinding of the rod to roll the pump jack down the pole upon release of the foot pedal 40. As best seen in FIG. 1, crank arm 160 is arranged on the distal end of an axial shaft 162 which is an extension of the helical rod 150 (not shown in FIG. 1). Crank arm 160 includes a coupling arm 164 which is pivotally coupled to the axial shaft 162 of rod 150 at pins 166 shown in FIGS. 3 and 4.

At the opposite end of the coupling arm 164, is connected a handle 168 for grasping the crank arm in order to rotate it.

Figure 3:
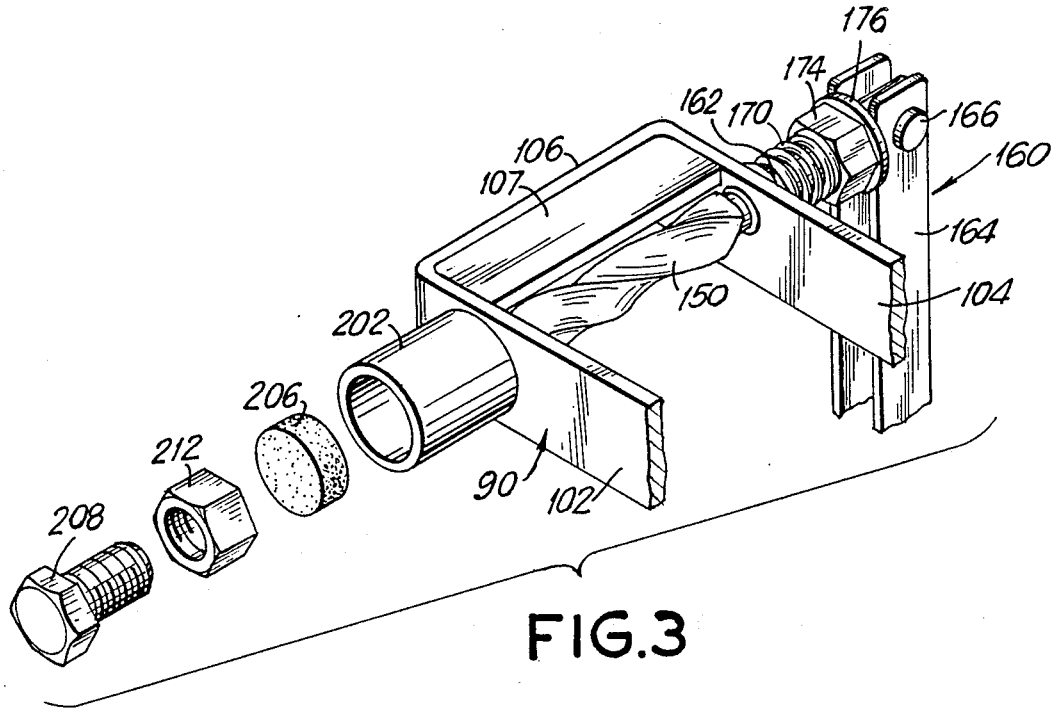
FIG. 3 is an exploded perspective, partially cutaway view of the yoke member of the upper shackle, with the axial-perma-clutch of FIGS. 1 and 2.
Figure 4:
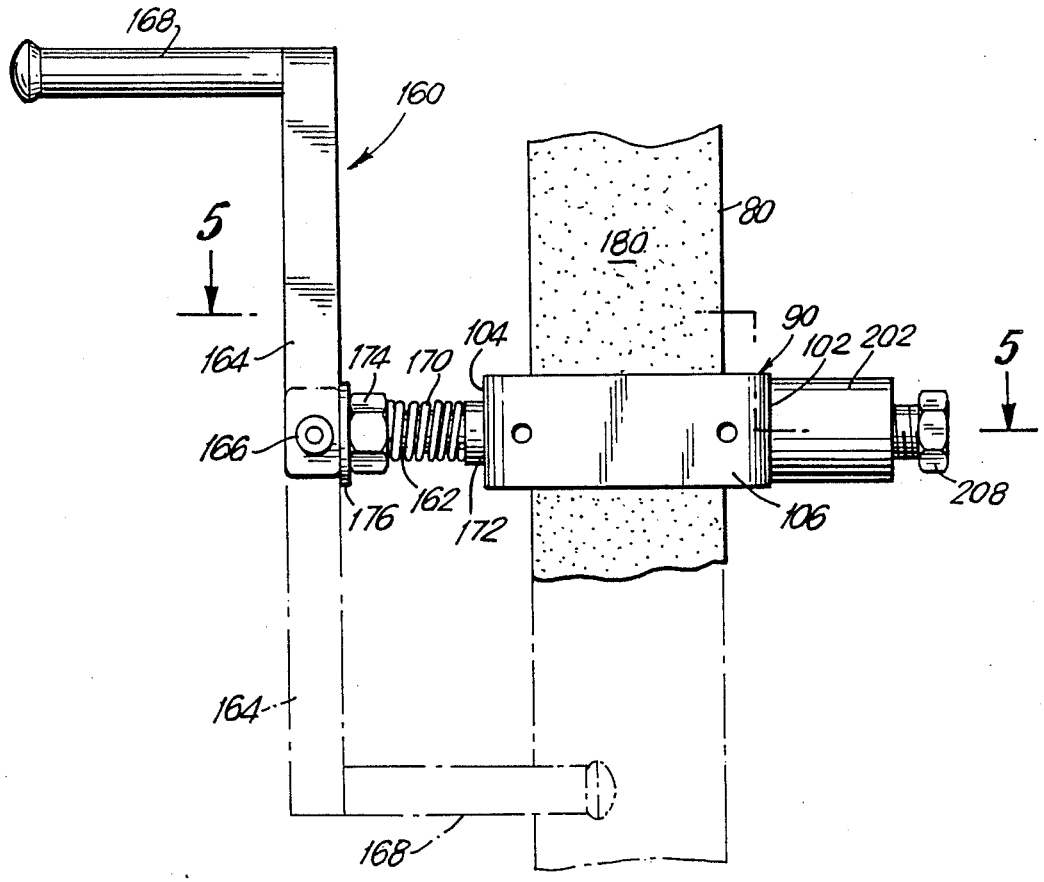
FIG. 4 is a side view of the handle and the yoke member with the axial perma-clutch of the invention and showing the operating position and the safety position of the handle.
Figure 5:
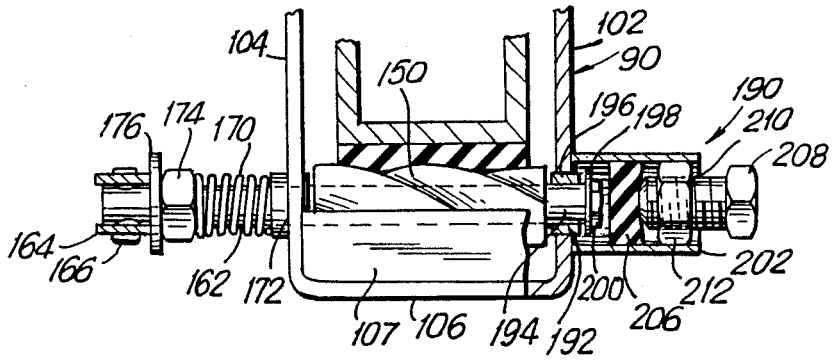
FIG. 5 is a sectional view taken along line 5–5 of FIG. 4.

As best seen in FIGS. 3 to 5, a spring coil 170 is placed on the axial extension or shaft 162 of the helical rod 150. Spring coil 170 is secured between a boss 172 formed against the side wall of the yoke member 90 of the upper shackle and a nut 174 which rests on a washer 176 abutting against the side wall of the coupling arm 164. Helical rod 150 grips a rubberized surface 180 of the aluminum pole 80. Crank arm 160 in conjunction with the spring 170 constitute an over center spring arrangement having two end positions for operational use to ride down the pump jack 10 along the pole 80 and for a safety position during upward climbing of the pump jack along the pole.

During the upward movement, crank arm 160 is turned so that the handle 168 points inwardly as shown in dotted lines in FIG. 4. As the handle is pointed inwardly it will lock against the frame of the pump jack and against the rubberized surface 180 of pole 80 and will thereby prevent spin-out of the helical rod 150. Thus once handle 168 is turned inwardly it locks against the front surface of the pole and prevents accidental unrolling of the helical rod 150.

During the downward movement of the pump jack along the pole, crank arm 160 is moved into the position illustrated in FIG. 4 in solid line. In this position the handle 168 faces outward to permit engagement by the hand of the worker to unwind the crank arm thereby permitting the pump jack to ride down the pole. Washer 176, nut 174 and spring coil 170 act on the side face of the crank arm 160 so as to securely hold in place the crank arm in its two end positions.

It is understandable that after raising or lowering the scaffolding platform to a desired position handle 168 must be placed so that it faces inwardly and will abut against rubberized surface 180 of pole 80 to lock the pump jack relative to the pole. However, occasionally workers may not bend the handle inwardly to lock it. In such cases, there could be a tendency for the roller to spin-out by itself thereby dropping the pump jack downward along the pole.

This spin-out problem is further aggravated if the crank arm is lubricated. The lubricator tends to loosen the spin and even further the risk of spin-out. As a result, lubrication has been avoided along the crank shaft. However, this now presents the problem that without lubricity, the crank shaft, due to abrasion can grind down to the point where it breaks from its holder. While the cover plate 107 can provide some protection, it doesn't solve the basic problem of the need for lubricity. Likewise using larger bearings will provide for longer wear, but again this avoids solving the basic problem.

In order to prevent accidental unwinding of the handle and thus permit slidedown of the pump jack in case a worker did not bend the handle 168 into its locking position, an axial perma-clutch or anti-spin device denoted at 190, is provided at the end of the helical rod 150 opposite to that end carrying the crank arm . As seen in FIGS. 3 to 5, there is provided an inner sleeve or shoulder bushing 192 straddling across the yoke member 90 and surrounding an axial shaft portion 194 of helical rod 150. Inner sleeve or bushing 192 is inserted in a bore 196 formed in the side wall of the yoke member 90 and projects outwardly from the latter. A washer 198 with a bolthead 200 closes the end of the axial shaft portion 194 and is rotated therealong.

The axial frictional perma-clutch 190 is housed in an outer cup-shaped sleeve 202 connected as an extension to the yoke member 90, for example, by welding. It comprises a resilient, disc-shaped friction element 206 made, for example, of rubber or Nylon and placed between the head of bolthead 200 and the inner end of an external bolt 208 inserted through a bore 210 in an end wall of cup-shaped sleeve 202 and tightened by a nut 212 located within sleeve 202. Rubber disc 206 may be approximately ⅜" thick or other size as needed. By turning the head of the bolt 208, the disc-shaped element 206 is moved towards the helical rod 150 and abuts against the bolthead 200 resulting in the friction and clutch arrangement which provides a tight engagement of element 206 against rod 150. This clutch engagement renders the rotational movement of the helical rod during its winding and unwinding motions more difficult as compared to those of conventional helical rods. The frictional clutch 190 prevents handle 168 from automatically unwinding and thus accidental sliding down of the pump jack even if the workers did not bend the handle inward to its safety position.

As a result of the clutch, it is now also possible to use lubrication along the crank shaft. Even with the lubrication, the crank arm will not automatically spin-out because of the clutch. This now permits the use of permanent lubrication and even ball bearings thereby increasing the wear of the rod and avoiding grind down of the rod.

A further benefit that results is an increase in the step during vertical upward stepping of the pump jack. Heretofore, there is a tendency for the helical rod to turn counter-clockwise up to 170° with each upward pumping stroke of the pumping jack. The axial perma-clutch 190 restricts this spiral counter-clockwise motion of rod 150. Therefore, in addition to eliminating the spin-out of the helical rod 150, an increased distance in the upward direction per each pumping stroke is achieved, and the worker can work faster.

As the helical rod-bolt connection wears out bolt 208 can be re-tightened to additionally compress disc-shaped friction element 206 towards bolt 200 of the helical rod 150. Friction engagement of the disc-shaped element 206 with the end of the helical rod 150 also functions as a brake during unwinding of the helical rod. Bolt 208 is tightened until an increased resistance is obtained due to contact of the element 106 with bolt 200. The bolt 208 can be constructed with a stop so that it cannot be removed and this will prevent workers from defeating the clutch.

In order to compensate for a frictional force applied to the helical rod 150 and handle 160 by friction element 206 and to facilitate actual winding down of the crank arm 160 by hand during normal operation, the coupling arm 164 of handle 160 can be made longer, for example, by one inch, as compared to conventional handles of the foregoing type, to increase mechanical leverage of the coupling arm.

There has been disclosed heretofore the best embodiment of the invention presently contemplated. However, it is to be understood that various changes and modifications may be made thereto without departing from the spirit of the invention.

What is claimed is:

1. A pump jack arranged for traveling up and down a pole, comprising:

a frame member;

a lower shackle member and an upper shackle member both supported on said frame member; and

2. A pump jack as in claim 1, wherein said helical rod has at a second end thereof a shaft extending outwardly from said yoke member, said crank arm means being connected to said shaft.

3. A pump jack as in claim 2, wherein said crank arm means includes an L-shaped handle including a coupling arm and a crank arm, said coupling arm having a medial end pivotally connected to said shaft of said helical rod, a spring mounted on said shaft and biasing said crank arm means when said crank arm means cranks the helical rod, said handle extending outwardly of said yoke member in said first position and inwardly towards said yoke member in said second position to lock said handle against the pole.

4. A pump jack as in claim 1, wherein said antispin friction means further include an external bolt which is tightened to press said resilient member against said bolthead.

5. A pump jack as in claim 4, wherein said external bolt has an end abutting against said resilient member and carrying on said end a nut.

6. A pump jack as in claim 5, wherein a washer is provided between said bolt and said bushing on said axial shaft portion.

7. A pump jack as in claim 6, wherein said anti-spin friction means further include housing means connected to said yoke member and accommodating said bolt, said washer, said resilient element, said nut and said end of said external bolt.

8. A pump jack as in claim 7, wherein said housing means is a cup-shaped sleeve.

9. A pump jack as in claim 8, wherein said cupshaped sleeve is welded to said yoke member.

10. A pump jack as in claim 6, wherein said external bolt has a head positioned outside said housing means.

11. A pump jack as in claim 1, wherein said resilient member is disc-shaped.

12. A pump jack as in claim 1, wherein said resilient member is made of rubber.

13. A pump jack as in claim 1, wherein said resilient member is made of Nylon.

14. A pump jack as in claim 10, wherein said housing means is cup-shaped and has a bottom wall having a bore, said external bolt passing through said bore into said cup-shaped housing means.

15. A pump jack arranged for traveling up and down a pole, comprising a frame member;

a lower shackle member and an upper shackle member both supported on said frame member; and a pump arm pivotally coupled to said frame member and causing said lower and upper shackle members to alternately grip the pole to thereby move the pump jack up the pole;

said upper shackle member including a yoke member having at a front end thereof a helical rod for applying a gripping force to the pole to permit the pump jack to roll up the pole, and crank arm means for cranking said rod along a surface of the pole; and anti-spin friction means provided at one end of said helical rod to prevent accidental rolling thereof along the pole, said helical rod having at said one end an axial shaft portion extending outwardly from said yoke member, said friction means including a resilient member acting on said axial shaft portion to brake a cranking motion thereof, said yoke member having a bore, a bushing received in said bore, said axial shaft portion rotatingly extending through said bushing, and a bolt at the distal end of said shaft portion and having a bolthead, said resilient member pressing against said bolthead to apply said friction force to said shaft portion;

said friction means further including an external bolt which is tightened to press said resilient member against said bolthead, said external bolt having an end abutting against said resilient member and carrying on said end a nut.

16. A pump jack as in claim 15, wherein a washer is provided between said bolt and said bushing on said axial shaft portion.

17. A pump jack as in claim 16, wherein said anti-spin friction means further include housing means connected to said yoke member and accommodating said bolt, said washer, said resilient element, said nut and said end of said external bolt.

18. A pump jack as in claim 17, wherein said housing means is a cup-shaped sleeve.

19. A pump jack as in claim 18, wherein said cup-shaped sleeve is welded to said yoke member.

20. A pump jack as in claim 16, wherein said external bolt has a head positioned outside said housing means.

21. A pump jack as in claim 16, wherein said resilient member is disc-shaped.

22. A pump jack as in claim 16, wherein said resilient member is made of rubber.

23. A pump jack as in claim 16, wherein said resilient member is made of Nylon.

24. A pump jack as in claim 20, wherein said housing means is cup-shaped and has a bottom wall having a bore, said external bolt passing through said bore into said cup-shaped housing means.

* * * * *

UNITED STATES PATENT AND TRADEMARK OFFICE

CERTIFICATE OF CORRECTION

PATENT NO. : 4,942,941

DATED : July 24, 1990

INVENTOR(S) : Carl Anderson

It is certified that error appears in the above-identified patent and that said Letters Patent is hereby corrected as shown below:

Claim 1 should read as follows:

1. A pump jack arranged for traveling up and down a pole, omprising:

a frame member;

a lower shackle member and an upper shackle member both upported on said frame member; and a pump arm pivotally coupled to said frame member and ausing said lower and upper shackle members to alternately grip he pole to thereby move the pump jack up the pole;

said upper shackle member including a yoke member having at front end thereof a helical rod for applying a gripping force to he pole to permit the pump jack to roll up the pole, and crank rm means for cranking said rod along a surface of the pole, said rank arm means being provided on one end of said helical rod; and anti-spin friction means provided on another opposite end f said helical rod, said anti-spin friction means applying a riction force to said helical rod so as to prevent accidental olling thereof along the pole, said crank arm means being turnable etween a first position in which it can crank the helical rod and a second position in which it locks said helical rod, said riction means applying a friction force to said helical rod in aid first and second positions,

UNITED STATES PATENT AND TRADEMARK OFFICE

CERTIFICATE OF CORRECTION

PATENT NO. : 4,942,941

DATED : July 24, 1990

INVENTOR(S) : Carl Anderson

It is certified that error appears in the above-identified patent and that said Letters Patent is hereby corrected as shown below:

said helical rod having at said one end an axial shaft portion extending outwardly from said yoke member, said friction means including a resilient member acting on said axial shaft portion to brake a cranking motion thereof, wherein said yoke member has a bore, a bushing received in said bore, said axial shaft portion rotatingly extending through said bushing, and a bolt at the distal end of said shaft portion and having a bolthead, said resilient member pressing against said bolthead to apply said friction force to said shaft portion.

Signed and Sealed this

Twenty-fourth Day of September, 1991

*Attest:*

HARRY F. MANBECK, JR.

*Attesting Officer*

*Commissioner of Patents and Trademarks*